US009883984B2

(12) United States Patent
Reda

(10) Patent No.: US 9,883,984 B2
(45) Date of Patent: Feb. 6, 2018

(54) METHOD AND MECHANISM FOR SECURING A REMOVABLE TRAY TO A WALKER

(71) Applicant: Yunga Tart LLC, Edina, MN (US)

(72) Inventor: Kareem Reda, Edina, MN (US)

(73) Assignee: YUNGA TART LLC, Edina, MN (US)

( * ) Notice: Subject to any disclaimer, the term of this patent is extended or adjusted under 35 U.S.C. 154(b) by 501 days.

(21) Appl. No.: 13/838,973

(22) Filed: Mar. 15, 2013

(65) Prior Publication Data

US 2014/0261589 A1 Sep. 18, 2014

(51) Int. Cl.
*A61H 3/00* (2006.01)
*A61H 3/04* (2006.01)

(52) U.S. Cl.
CPC ..... *A61H 3/00* (2013.01); *A61H 3/04* (2013.01); *A61H 2003/004* (2013.01); *Y10T 29/49826* (2015.01)

(58) Field of Classification Search
CPC ..... A61H 3/00; A61H 3/04; A61H 2003/004; A61G 5/10; A47K 3/122; A47B 37/00; Y10T 29/49826
USPC ..... 135/66–67, 85; 280/250.1, 304.1, 280/87.021; 297/5–9, 38, 183.1, 183.6, 297/183.9, 344.18, 440.1, 440.13, 440.2, 297/3; 4/559, 578.1; 29/428, 453
See application file for complete search history.

(56) References Cited

U.S. PATENT DOCUMENTS

| | | | | |
|---|---|---|---|---|
| 3,199,467 | A * | 8/1965 | Compton | 108/49 |
| 3,631,821 | A * | 1/1972 | Zachariou | 108/152 |
| 4,191,113 | A * | 3/1980 | Hogberg | 108/157.16 |
| 4,251,044 | A * | 2/1981 | Olson | 248/166 |
| 4,316,547 | A * | 2/1982 | Varon | 211/105.1 |
| 4,557,446 | A * | 12/1985 | Barron | 248/65 |
| 5,170,810 | A * | 12/1992 | Chapin | 135/66 |
| 5,368,364 | A * | 11/1994 | Kanai | 297/411.27 |
| 5,694,959 | A * | 12/1997 | Hiller et al. | 135/66 |
| 5,749,305 | A * | 5/1998 | Jacovelli | 108/44 |
| 5,765,922 | A * | 6/1998 | Hsia | 297/440.1 |
| 6,375,134 | B1 * | 4/2002 | Goldschmidt et al. | 248/154 |
| D464,829 | S * | 10/2002 | Henry et al. | D6/491 |
| 6,675,979 | B2 * | 1/2004 | Taylor | 211/186 |
| 6,883,529 | B2 * | 4/2005 | Kvaternik | 135/66 |
| 6,974,191 | B2 * | 12/2005 | Serhan | 297/440.24 |
| D519,291 | S * | 4/2006 | Higgs et al. | D6/367 |
| 7,040,637 | B2 * | 5/2006 | Owens et al. | 280/87.021 |
| 8,578,863 | B2 * | 11/2013 | Peery et al. | 108/91 |

(Continued)

*Primary Examiner* — Winnie Yip
(74) *Attorney, Agent, or Firm* — Westman, Champlin & Koehler, P.A.; Z. Peter Sawicki; Amanda M. Prose

(57) ABSTRACT

A mechanism and method for securing a removable tray to a walker frame. The mechanism comprises a removable spacer wherein the spacer is adapted to frictionally engage the walker tray with a walker handle. The method of attaching the removable walker tray to the walker frame comprises securing a first spacer to a first cutout in the walker tray; securing a second spacer to a second cutout in the walker tray; inserting a first walker handle into the first cutout in the tray; inserting a second walker handle into the second cutout in the tray; and where upon inserting the walker handles into the cutouts, the tray is positioned on top of the walker frame and the tray secured in a substantially level position on the walker frame by frictional engagement of the spacer between the tray and the walker handles.

5 Claims, 7 Drawing Sheets

(56) References Cited

U.S. PATENT DOCUMENTS

| | | | | |
|---|---|---|---|---|
| 2003/0102700 | A1* | 6/2003 | Lin | 297/183.9 |
| 2004/0051365 | A1* | 3/2004 | Darst et al. | 297/440.1 |
| 2006/0261569 | A1* | 11/2006 | Delhotal | 280/87.021 |
| 2007/0051864 | A1* | 3/2007 | Bartell et al. | 248/346.01 |
| 2007/0199911 | A1* | 8/2007 | Chen | 211/189 |
| 2008/0041282 | A1* | 2/2008 | Goschy et al. | 108/141 |
| 2008/0141911 | A1* | 6/2008 | McKenna | 108/50.16 |
| 2009/0229094 | A1* | 9/2009 | Reese | 24/530 |
| 2011/0186578 | A1* | 8/2011 | Kawakami | 220/378 |
| 2013/0070171 | A1* | 3/2013 | Boyer, Jr. | 348/837 |
| 2013/0256253 | A1* | 10/2013 | Stuby | 211/186 |

* cited by examiner

METHOD AND MECHANISM FOR SECURING A REMOVABLE TRAY TO A WALKER

FIELD OF THE INVENTION

The present invention relates to a walker tray and an attachment for securing and stabilizing the tray to a walker.

BACKGROUND OF THE INVENTION

Most walkers are of a standard construction, including at least two side frames, which generally include handles or hand grips for a user to grab and move the walker. Also included is a front frame that is connected by the side frames. A walker allows the user extra stability while walking or standing. It is known in the prior art to offer a removable tray for attachment to a walker. A walker tray allows the user to attach the tray to the walker allowing the user multiple uses of the walker.

General walker and walker tray configurations limit the point of attachment of the tray to the walker, based on the construction of a walker frame. Trays may not fit onto a walker in a stable or generally horizontal fashion, preventing the use of the walker tray as a utility surface during movement of a walker.

Additionally, removable trays for improved stability in the prior art render a cup holder hole useless when the tray is attached to the walker when the method of stabilizing the tray extends under the tray blocking the cup hole. The mechanisms for folding the walker up also can block the cup hole, preventing a user from using the cup holder as intended.

The trays of the prior art cannot universally be attached to all walker frames in a level that is a substantially horizontal position. This requires the user to use abundant caution when setting uncovered bowls or cups of soups or other liquids to prevent the inevitable spills and splashes of the liquid.

Removable walker trays have been described in the prior art including U.S. Pat. Nos. 5,569,959, 7,980,263, and 6,883,529. However the prior art walker trays lack support and the ability to be attached in way that can be adjusted based on the desire of the user, while retaining full functionality of the walker and the tray and without requiring a specialized walker or a permanent tray attached to the walker.

SUMMARY OF THE INVENTION

This disclosure relates to a mechanism for securing a removable tray to a walker frame. The mechanism comprises a removable spacer wherein the spacer is adapted to frictionally engage the walker tray with a walker handle. The spacer is securable to the walker tray such that when the walker tray is placed on a walker frame, the tray is secured substantially horizontally level to a ground surface by engagement of the spacer with the walker handle.

This disclosure also relates to a method of attaching a removable walker tray to a walker frame, the method comprises securing a first spacer to a first cutout in the walker tray; securing a second spacer to a second cutout in the walker tray; inserting a first walker handle into the first cutout in the tray; inserting a second walker handle into the second cutout in the tray; and where upon inserting the walker handles into the cutouts, the tray is positioned on top of the walker frame and the tray secured in a substantially level position on the walker frame by frictional engagement of the spacer between the tray and the walker handles.

DETAILED DESCRIPTION OF THE INVENTION

This disclosure describes a walker tray and a spacer for attachment to the walker tray. The use of the spacer in attaching the walker tray to a walker frame allows the walker tray to be securely attached in a desired position to the frame. The spacer permits attachment of the tray to a variety of walker frames as explained further below. The spacer can also support attachment of the tray to the frame at a height selected by the user. The spacer also allows the tray to be attached to the walker frame, the tray being secured substantially horizontally with respect to a ground surface, the ground surface supporting the walker frame. When the spacer is inserted properly, the tray can be secured to the walker wherein the tray does not wobble and is retained steadily in a substantially horizontal or level position. The spacer, when attached, also allows both the tray and the walker to retain full functionality.

Figure 1:
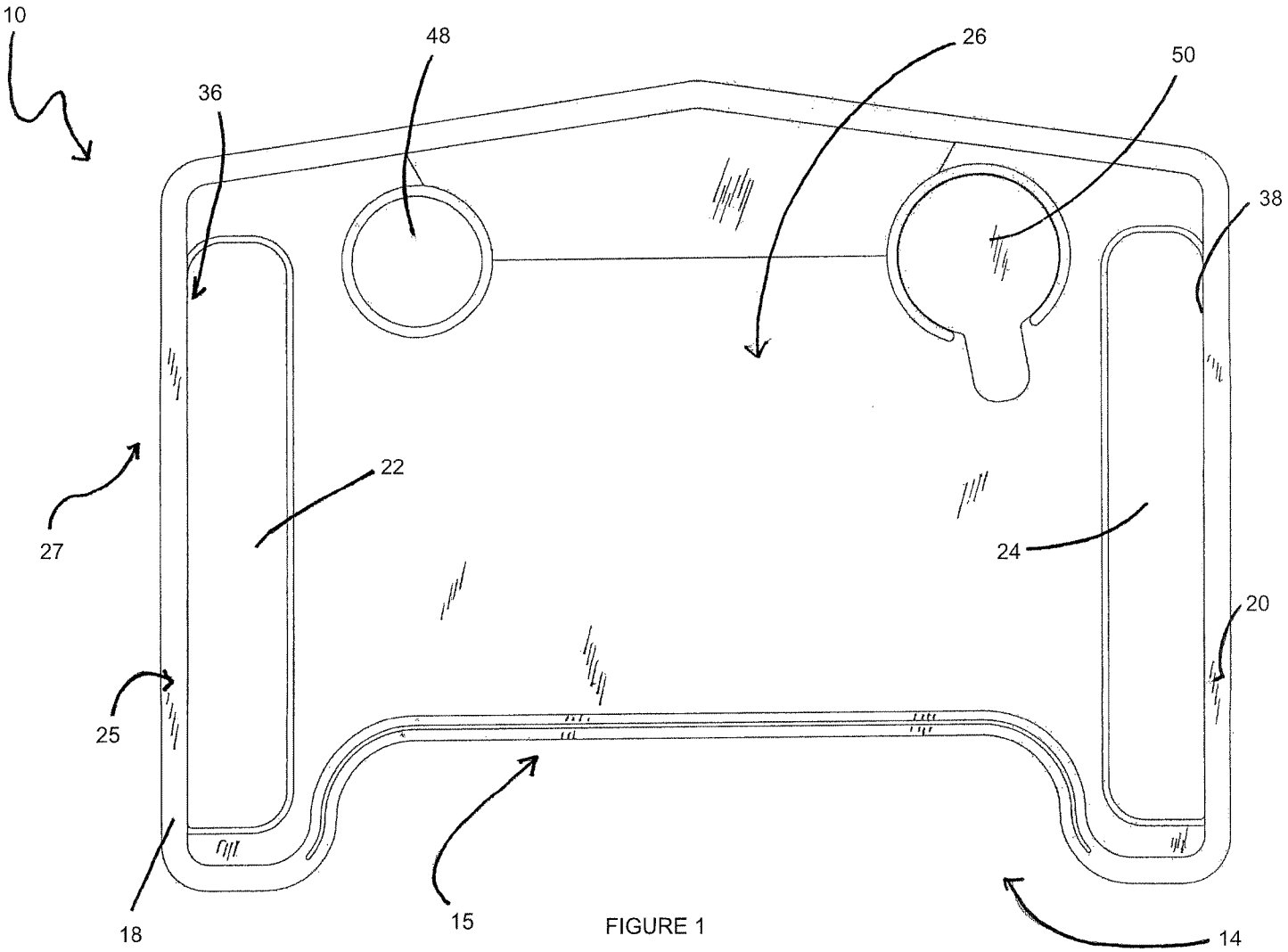
FIG. 1 is a top view of the tray.

Illustrated in further detail in FIG. 1 is an exemplary version of the walker tray 10 of this disclosure. The walker tray 10 is made of a durable plastic or other suitable, lighter weight material. The tray 10 is of a thickness sufficient enough to be sturdy for holding items, but no so thick as to inhibit attachment to and use of a walker 80. The walker tray 10 is generally rectangular in shape, with a forward edge 12 and user facing edge 14. The forward facing edge 12 comprises a leading edge 16, which allows for a greater surface area of the tray 10. The user facing edge includes an indentation 15 extending substantially the length of the user facing edge 14 between cutouts 22 and 24. The tray 10 includes two side edges 18 and 20. The walker tray comprises a generally smooth, substantially flat user surface, or top surface 26. The tray 10 includes a lip 25 that extends generally around a perimeter portion 27 of the top or utility surface 26. The lip 25 forms a raised surface, which aids in retaining material, such as utensils, plates, cups or bowls.

Figure 3:
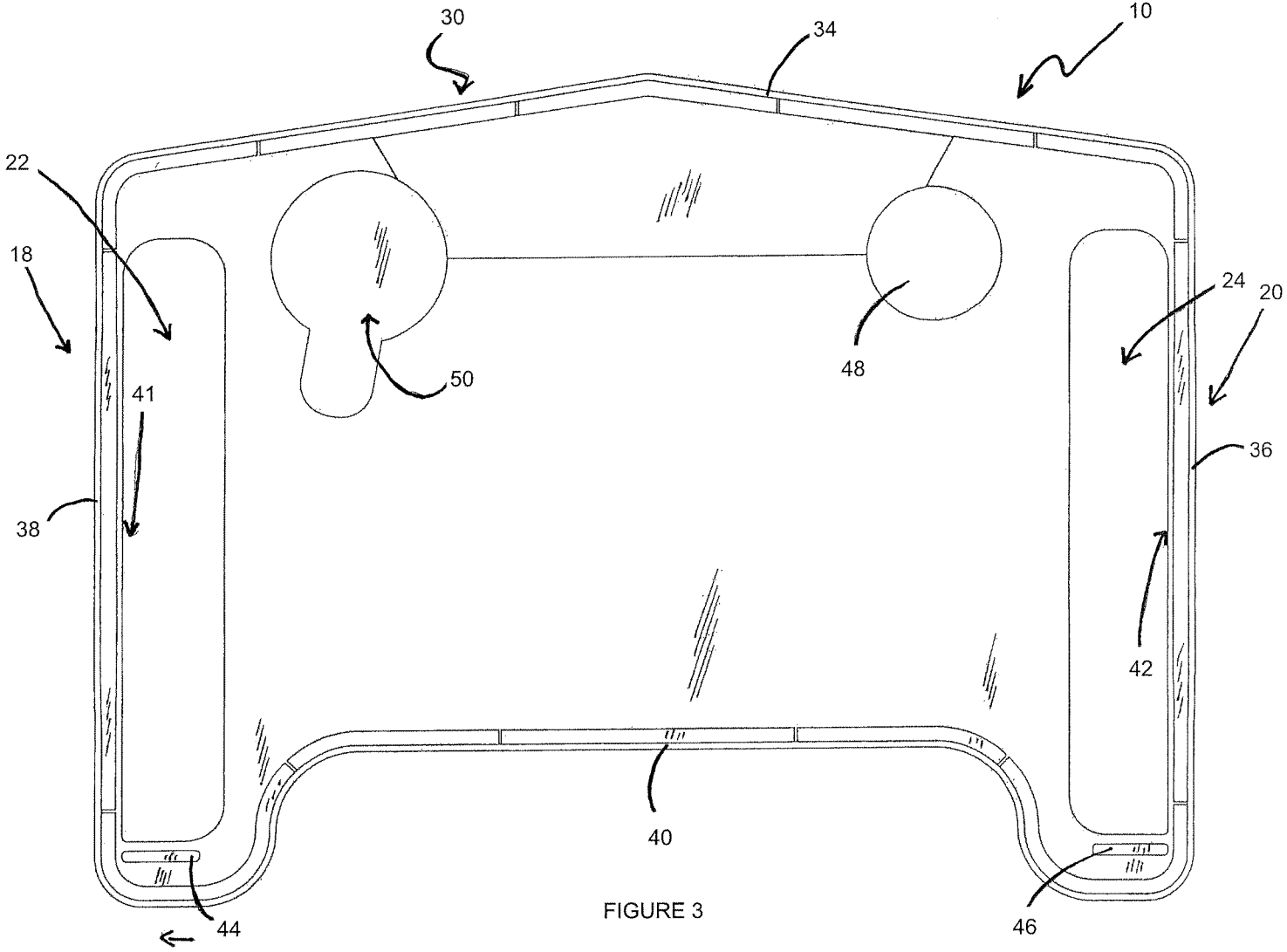
FIG. 3 is a bottom view of the walker tray.

The tray 10 illustrated in FIGS. 1 and 3 also includes a perimeter skirt 30 extending downward from the lip 25 about the perimeter of the tray 10. In the illustrated embodiment, the perimeter skirt 30 includes a forward edge side wall 34, a left side wall 36, a right side wall 38, and a user facing side wall 40, which cooperatively define a continuous side wall about a perimeter 24 of the tray 10. The side walls 34, 36, 38 and 40 or skirt 30 provide structural integrity for the tray 10, prevent the tray 10 from flexing as pressure is applied to the substantially flat surface 26.

Figure 6:
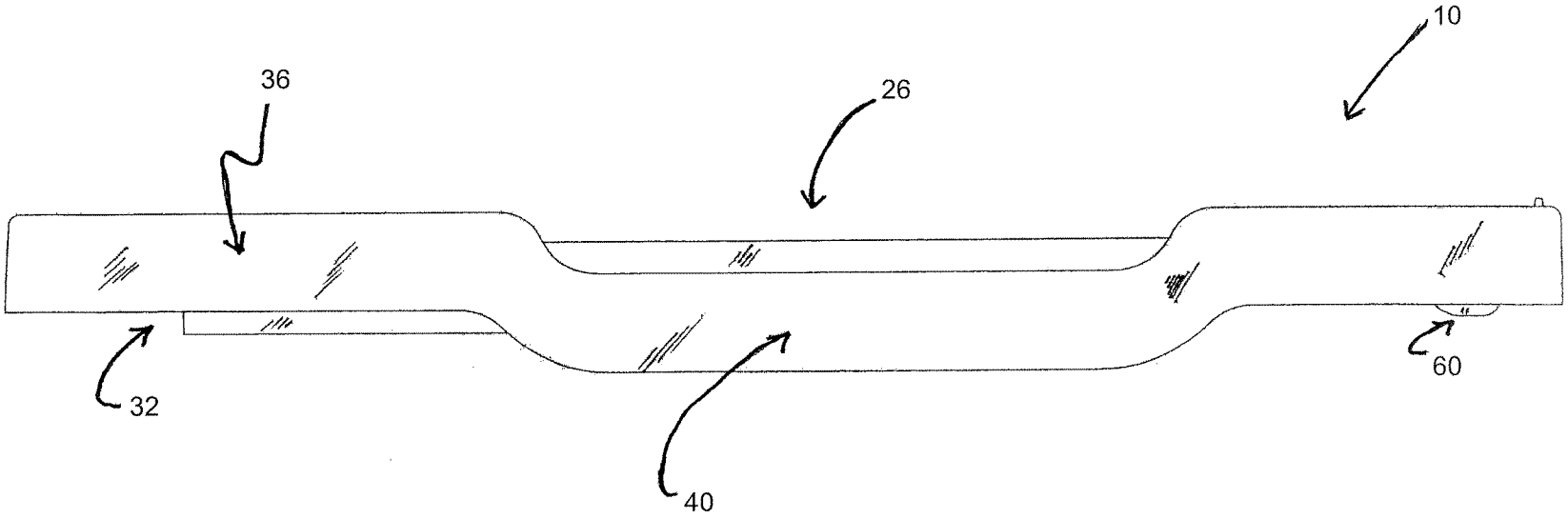
FIG. 6 is a right side view of the tray, which is a mirror image of the left side view of the tray.

As illustrated in FIGS. 1 and 3, the walker tray 10 includes substantially rectangular cutouts 22 and 24 adjacent to the lip 22 and proximate side walls 36 and 38. The cut outs 22 and 24 substantially co-extend along the lip 25 along side edge 18 and 20. The cut outs 22 and 24 are of sufficient length and width to fit over walker handles such that the walker handles extend through the cut outs 22 and 24. The cut outs 22 and 24 are used to attach the tray 10 to the walker. Illustrated in farther detail in FIG. 6, the side walls 36 and 38 are adapted with a depressed length 41 and 42 substantially along the length of the cut outs 22 and 24. The depressed length, or adapted sections 40 and 42 allow for extra room between a users hands or knuckles and the tray sides when the walker handles 78 and 82 extend through the tray cutouts 22 and 24 thereby allowing a user to fully grip the walker handles without scraping the tray with the user's fingers.

A lip or extension portion 44 and 46 extends from the bottom surface of the walker tray close to the proximal end of each of the cutouts 22 and 24, extending along the width of the cutouts. The lips 44 and 46 supports attachment of the spacer to the tray.

The walker tray 10 also includes a circular cut out 48, which may be used as a cup holder. The top surface 26 also includes a depression 50, the depression 50 being in the shape to accommodate a mug with a handle.

Figure 2:
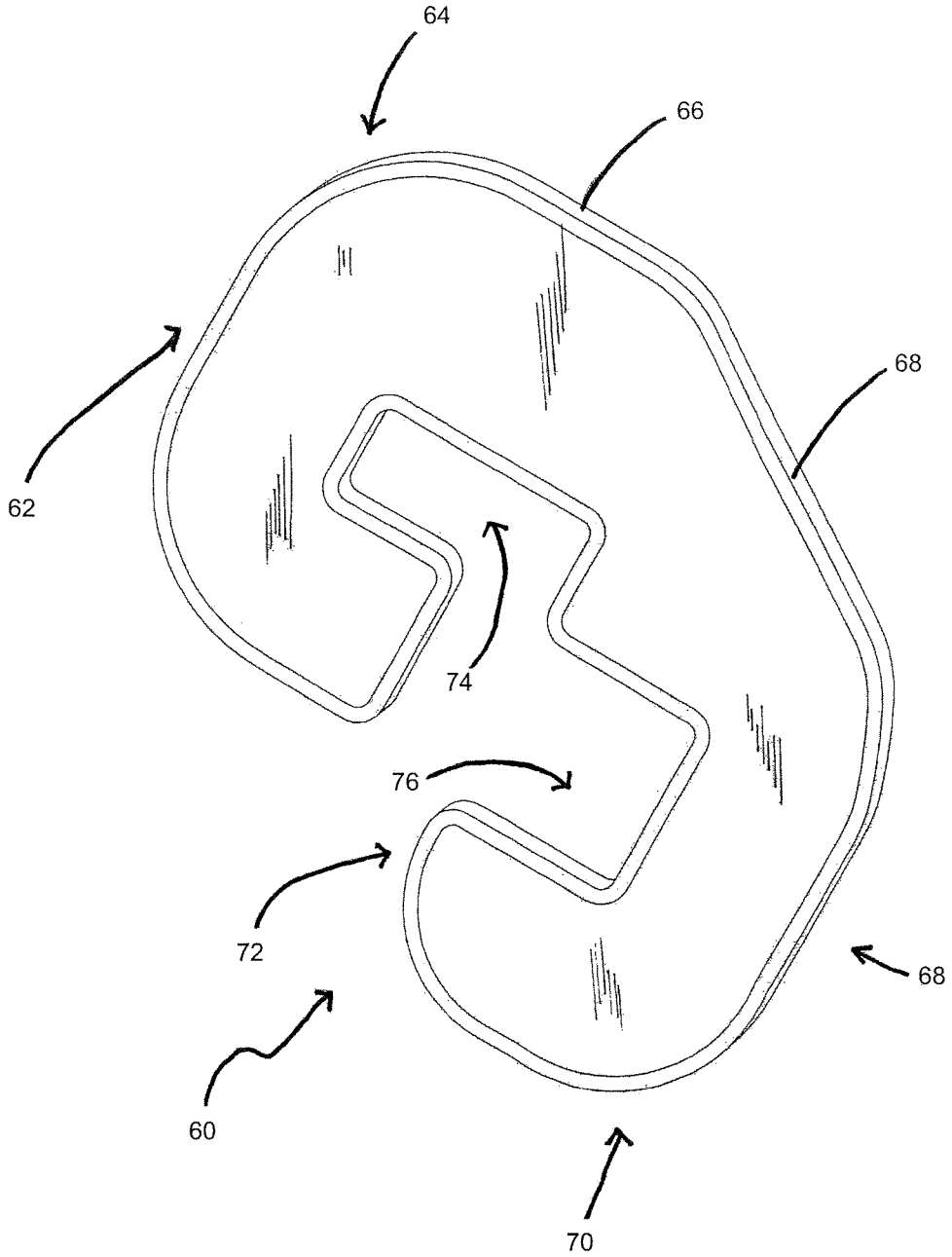
FIG. 2 is a perspective view of the spacer.

Illustrated in FIG. 2 is a spacer 60 of this disclosure. The walker tray 10 and spacer 60 can be used with a majority of standard walkers in the marketplace. The spacer 60 is made from a suitable polymer that permits sufficient bending to attach to the tray while being sufficiently stiff to retain attachment of the spacer 60 to the tray 10. The spacer 60 is separable from the tray 10. The spacer 60 is sufficiently thick to be stable, but not so thick as to inhibit the spacer from snapping or sliding in to place. The spacer is also sufficiently wide to provide a sufficient surface for engagement with a surface of the walker handle 78 or 82.

Figure 4:
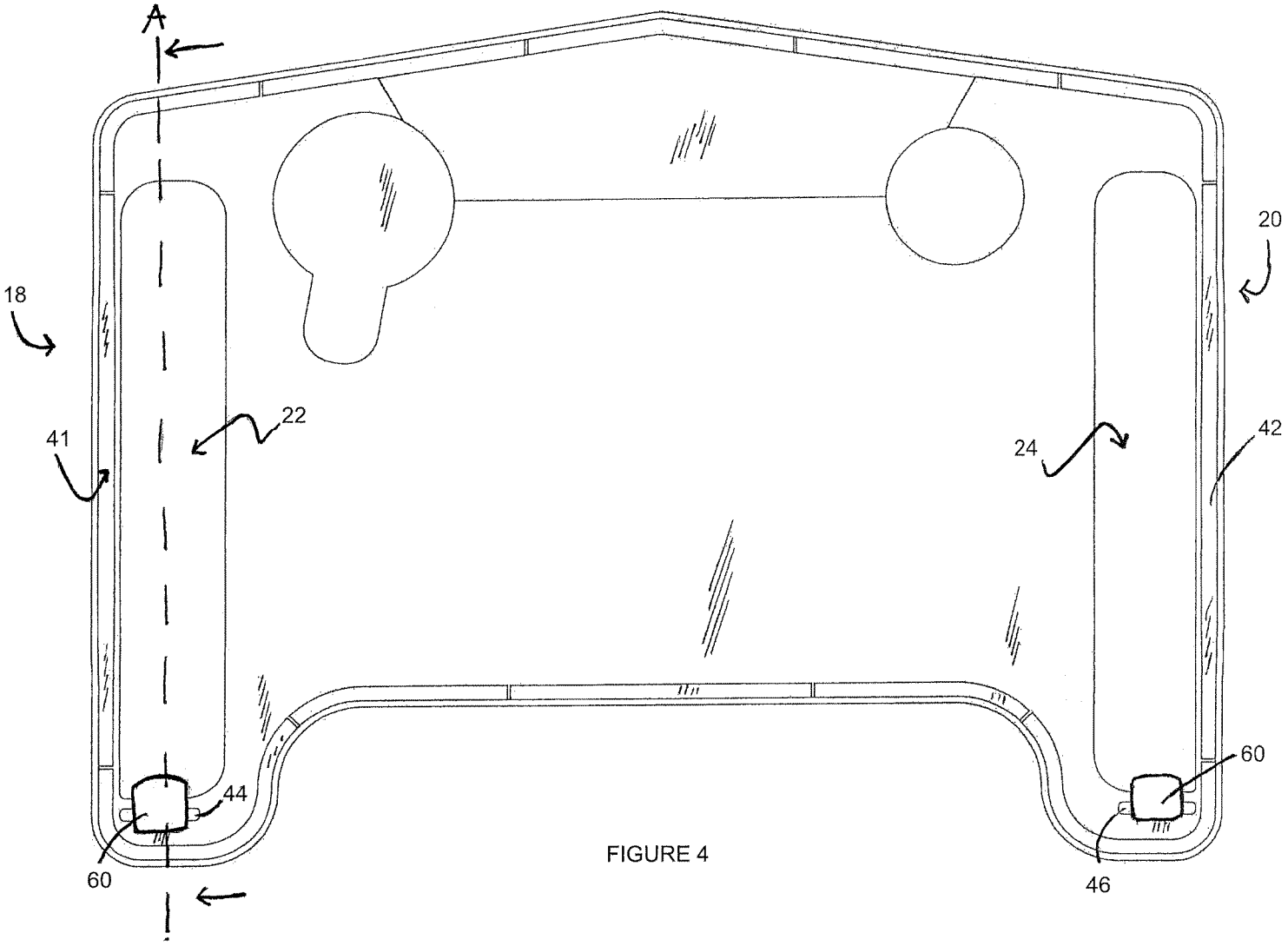
FIG. 4 is a bottom view of the walker tray with the spacers attached.
Figure 5:
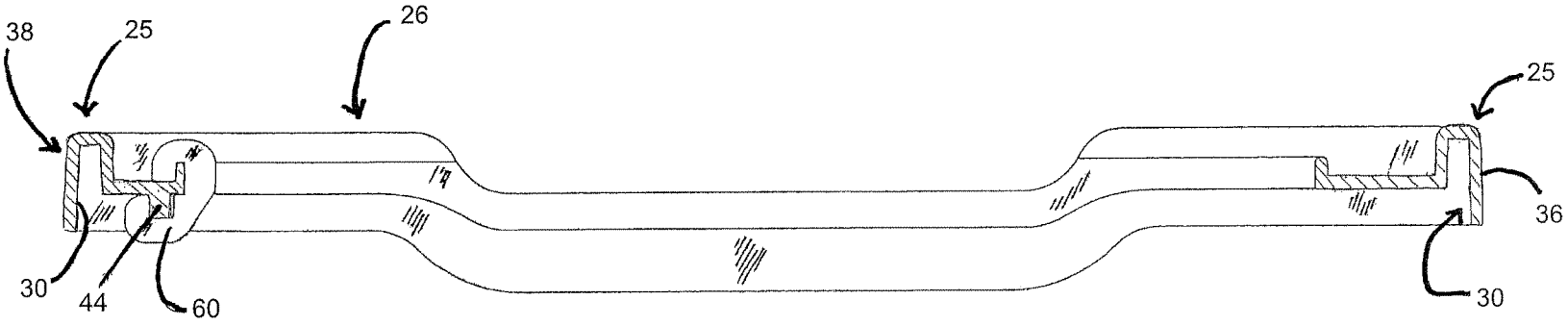
FIG. 5 is a cross-sectional side view along line A-A of FIG. 4.

Illustrated in further detail in FIG. 2, the spacer 60 comprises an outer side 62 that is generally rounded at the top 64 leading to a flat top side 66 which is connected by a rounded bend to substantially flat back side 68. The bottom side 70 of the spacer is generally rounded. The bottom edge 72 is further rounded to curve inward. The top inner side and space 74 is substantially rectangular in shape wherein the bottom side of the rectangular shape connects to the side of the top of the bottom inner side and space 76 which is substantially square shaped. When the spacer 60 is snapped into place (attached to the tray), the opening between the top portion and the bottom portion interacts with the tray 10 at the proximal edge of the width of the cutout 22 or 24. The top inner side and space 74 of the spacer interacts with the top surface 26 of the tray 10. The bottom inner side and space 76 of the spacer 60 interacts with the lip 44 or 46 and/or the bottom surface of the tray 10. AS illustrated in FIGS. 3, 4 and 5, the spacer is attached to the tray by inserting, for example, lip 46 into space 76. The top 64 of the spacer 60 is then bent slightly away from the edge of the cutouts 22 or 24 sufficiently to permit the top edge of the cutout 22 or 24 to be retained within the space 24. Due to the elasticity of the polymer that comprises the spacer 60, the spacer 60 although slight bent to attach to the tray, regains its original shape and is not deformed. The spacer can be removed and reused repeatedly.

The spacer 60 secures the tray 10 to the walker frame 80, by frictional engagement of the outer side 62 with the surface of the walker handle 78 or 82. The top inner side and space 74 frictionally engages with the top surface of the tray 26 at the cutout 22 or 24. The bottom inner side and space 76 frictionally engages with the tray 10 at the bottom surface of the tray 10 and/or with the lip 44 or 46. In essence, the spacer fills in the space between the tray 10 and the handles 78 or 82 of the walker. This space, in the past, has resulting in the tray "failing" to engage top mechanisms of the walker. This has resulting in trays not being level and not being secured to the walker.

The shape of the spacer is different at the top portion 64 and the bottom portion 72 to provide a visual and tactile cue to a user as to the preferred orientation of the spacer for insertion. In the illustrated example, the difference is the size between spaces 74 and 76.

The spacer 60 is preferably made of rubber, but can also be made of plastic or other suitable semi-flexible materials that would allow the spacer to snap into place. The spacer 60 permits the tray 10 to be used with various walker configurations. The spacer 60 engages the lip 44 or 46 and the proximal width of the cut out 22 or 24 simultaneously with a walker handle 78 or 82. The spacer 60 permits securing the tray 10 substantially horizontal to a ground surface, the ground surface supporting the walker frame 80, and at a selected height with respect to the handles 78 and 82. The spacer 60 can also snap into secure connection with the cut out handle portion of prior art trays, as the spacer 60 can be used securely with a tray without the lip.

Figure 7:
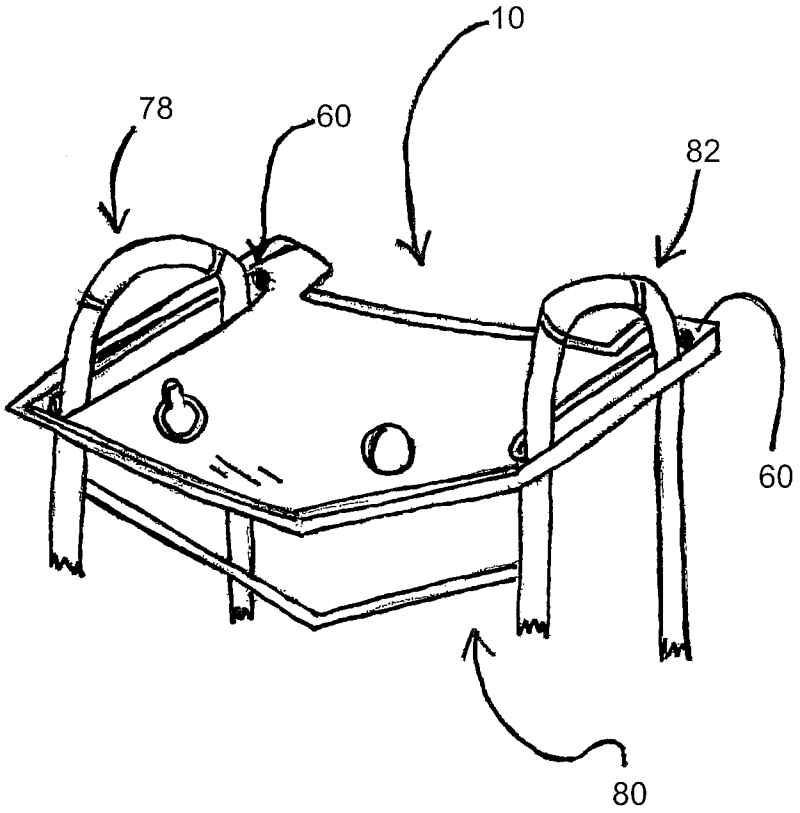
FIG. 7 is a perspective view of the walker tray and spacer attached to the walker.

As illustrated in FIG. 7, to secure the walker tray in a generally flat and horizontal position, a spacer can be secured in each cut out so that the spacer engages with each handle of the walker. Two or more spacers may be used to increase frictional engagement or stability of the walker tray when attached to the walker.

Although the present invention has been described with reference to preferred embodiments, workers skilled in the art will recognize that changes may be made in form and detail without departing from the spirit and scope of the invention.

What is claimed is:

1. A mechanism for securing a removable tray to a walker frame, the mechanism comprising:
- a removable spacer having a semi-arcuate length and comprising:
  - a first surface configured for engagement with a surface of the removable walker tray;
  - a second surface configured for engagement with a walker handle, such that the spacer is adapted to frictionally engage the removable walker tray with the walker handle extending through an opening in the walker tray such that when the walker tray is placed on a walker frame, the walker handle extends upwardly through the opening in the walker try, and
  - terminal ends of the arcuate length configured to further secure the removable spacer to the removable tray substantially horizontally to a ground surface by engagement of the second surface of the spacer with the walker handle.

2. The mechanism of claim 1 wherein the spacer is comprised of rubber.

3. The mechanism of claim 1 wherein the spacer is adapted to engage with a lip on a bottom surface of the walker tray.

4. A method of attaching a removable walker tray to a walker frame, the method comprising:
- securing a first spacer to a first cutout in the walker tray;
- securing a second spacer to a second cutout in the walker tray;
- inserting a first walker handle into the first cutout in the tray;
- inserting a second walker handle into the second cutout in the tray; and where upon inserting the walker handles into the cutouts, the tray is positioned on top of the walker frame and the tray is secured in a substantially level position on the walker frame by frictional engagement of the spacers with both the tray and the walker handles and between the tray and the walker handles.

5. The method of claim 4 wherein the spacer further engages with a lip on a bottom surface of the tray.

* * * * *